US009719172B2

(12) United States Patent
Chang et al.

(10) Patent No.: US 9,719,172 B2
(45) Date of Patent: Aug. 1, 2017

(54) METHOD FOR TREATING METAL SURFACE

(71) Applicant: National Central University, Taoyuan County (TW)

(72) Inventors: Jeng-Kuei Chang, Hsinchu (TW); Yi-Chen Wang, New Taipei (TW); Jheng-Yi Lin, Tainan (TW)

(73) Assignee: National Central University, Jhongli, Taoyuan County (TW)

( * ) Notice: Subject to any disclaimer, the term of this patent is extended or adjusted under 35 U.S.C. 154(b) by 273 days.

(21) Appl. No.: 14/335,749

(22) Filed: Jul. 18, 2014

(65) Prior Publication Data

US 2015/0203968 A1 Jul. 23, 2015

(30) Foreign Application Priority Data

Jan. 17, 2014 (TW) ..... 103101739 A

(51) Int. Cl.
*C23C 18/54* (2006.01)

(52) U.S. Cl.
CPC ..... *C23C 18/54* (2013.01)

(58) Field of Classification Search
CPC ..... C23C 22/05; C23C 22/73
See application file for complete search history.

(56) References Cited

U.S. PATENT DOCUMENTS

2010/0133520 A1* 6/2010 Bressers ..... C25C 5/56 257/40
2014/0178710 A1* 6/2014 Chen ..... C25D 5/10 428/610
2015/0090369 A1* 4/2015 Qu ..... C23C 22/57 148/250

OTHER PUBLICATIONS

Abbott et al. "Electroless deposition of metallic silver from a choline chloride-based ionic liquid: a study using acoustic impedance spectroscopy, SEM and atomic force microsopy", Physical Chemistry Chemical Physics, 2007, 9, p. 3735-3743.*

* cited by examiner

*Primary Examiner* — Lois Zheng
(74) *Attorney, Agent, or Firm* — Muncy, Geissler, Olds & Lowe, P.C.

(57) ABSTRACT

The present invention relates to a method for treating a metal surface, comprising (A) providing an ionic liquid solution and a substrate of a first metal, wherein the ionic liquid solution comprises an ionic liquid and an ion of a second metal; and (B) immersing the substrate of the first metal in the ionic liquid solution to form a coating layer of the second metal on a surface of the substrate of the first metal by reducing the ion of the second metal. The surface of the substrate of the first metal is protected by the coating layer of the second metal, thereby improving the corrosion resistance.

9 Claims, 7 Drawing Sheets

METHOD FOR TREATING METAL SURFACE

CROSS REFERENCE TO RELATED APPLICATION

This application claims the benefits of the Taiwan Patent Application Serial Number 103101739, filed on Jan. 17, 2014, the subject matter of which is incorporated herein by reference.

BACKGROUND OF THE INVENTION

1. Field of the Invention

The present invention relates to a method for treating a metal surface, and especially to a method for treating a surface of light metals, highly active metals or commonly used metals, such as magnesium, aluminum, zinc, titanium, iron, cobalt, nickel, silver, vanadium and chromium.

2. Description of Related Art

In recent years, due to the shortage of oil energy source, many transportation vehicles and electronic products adopt light metal materials to reduce the weight of the products for requirements for energy-saving and lightweight. For transportation vehicles, lightweight can reduce the fuel consumption required for driving, thus achieving energy conservation. The so-called light metal, generally refers to aluminum, magnesium, zinc, titanium and so on, which has a promising potential for future development due to the low specific gravity and high strength. According to the statistics, the current magnesium production in the world is about 429,000 tons, and is increasing every year. Thus, the applications and needs of a magnesium metal have attracted attentions in various fields. However, magnesium or its alloy has a poor corrosion resistance, and a surface treatment is typically required to enhance the corrosion resistance, thereby increasing its structural stability.

The current methods for treating a light metal surface are mostly anodic and chemical conversion treatments. The anodic or plasma treatment controls the formation of the oxide layer on the metal surface by applying voltage or other energy. However, the formed metal surface is not only rough but also electrically non-conductive, thereby affecting the electromagnetic shielding of the metal and reducing the availability of the metal. The chemical conversion treatment forms a protective layer on the metal surface by a passivator, and a chromate process liquid is typically used. However, chromate compounds are toxic, and their waste liquid is difficult to handle and hazardous to the environment. Therefore, due to the above problems, it is an important object to find a substitute for the chromate process liquid for the chemical conversion treatment.

SUMMARY OF THE INVENTION

An object of the present invention is to provide a method for treating a metal surface, wherein an ionic liquid is used as the electrolyte, and since the ionic liquid is characterized by a wide potential window, and do not react with or erode the (active) substrate, a spontaneous replacement reaction between the metal substrate and various metal ions in the ionic liquid will take place by reducing the metal ions in the ionic liquid solution on the surface of the metal substrate without energy supply, which forms a metal coating for providing corrosion protection. Because the ionic liquid has an extremely low volatility and is non-flammable, it complies with operation safety and is environmentally friendly.

The method for treating a metal surface of the present invention comprises: (A) providing an ionic liquid solution and a substrate of a first metal, wherein the ionic liquid solution comprises an ionic liquid and an ion of a second metal; and (B) immersing the substrate of the first metal in the ionic liquid solution to form a coating layer of the second metal on a surface of the substrate of the first metal by reducing the ion of the second metal.

In the present invention, to allow the replacement reaction to proceed to form the metal coating layer on the metal substrate, the second metal has a reduction potential higher than the first metal. The substrate of the first metal may be selected from the group consisting of magnesium, aluminum, zinc, titanium, iron, cobalt, nickel, silver, vanadium, chromium and alloys thereof, and preferably magnesium, aluminum, zinc, a magnesium-containing alloy, an aluminum-containing alloy, and a zinc-containing alloy. In addition, the ion of the second metal is selected from the group consisting of a copper ion, a nickel ion, a zinc ion, a titanium ion, an aluminum ion, a cobalt ion, a silver ion, a gold ion, a vanadium ion, a chromium ion, a manganese ion, a platinum ion, a palladium ion, and mixtures thereof.

Further, in the present invention, the ionic liquid in the step (A) may be composed of an anion and a cation containing at least one of nitrogen, phosphorus, and sulfur, wherein the cation may at least one selected from the group consisting of imidazolium cation, a pyrrolidinium cation, an alkylammonium cation, a pyridinium cation, a pyrazolium cation, a thiazolium cation, an alkylphosphonium cation, and an alkylsulfonium cation, wherein the imidazolium cation, the pyrrolidinium cation, the alkylammonium cation, the pyrrolidinium cation, the pyrazolium cation, the thiazolium cation, the alkyl phosphonium ion, and the alkyl sulfonium ion are represented by the following Formulas (I) to (VIII), respectively:

(I)

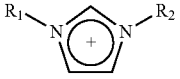

(II)

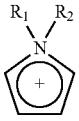

(III)

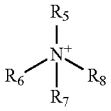

(IV)

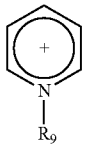

(V)

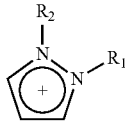

(VI)

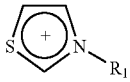

-continued (VII)

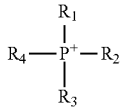

(VIII)

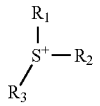

In Formula (I) to Formula (VIII), each of $R_1$, $R_2$, $R_3$, and $R_4$ may independently be hydrogen or $C_{1-10}$ alkyl, and preferably are each independently a hydrogen or $C_{1-5}$ alkyl. Preferably, in Formula (I) to Formula (VIII), each of $R_1$, $R_2$, $R_3$, and $R_4$, independently, is a hydrogen or $C_{1-5}$ alkyl.

Furthermore, in the present invention, the anion of the ionic liquid may be at least one selected from the group consisting of a dicyanamide anion, a (bis{(trifluoromethyl)-sulfonyl}amide) anion, a trifluoromethane-sulfonate anion, a tetrafluoroborate anion, and a hexafluorophosphate anion, wherein the anions are represented by the following Formulas (1) to (5), respectively:

(1)

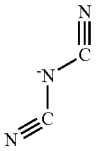

(2)

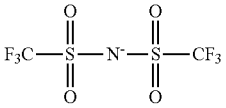

(3)

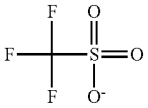

(4)

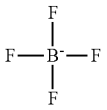

(5)

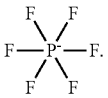

In summary, the ionic liquid used in the present invention may be formed of at least one of the above cations and at least one of the above anions, and thus the ionic liquid used in the present invention may include at least 40 kinds of ionic liquids by randomly pairing up these cations and anions.

Nevertheless, according to the surface treatment method provided by the present invention, the ionic liquid (A) in the step may preferably selected from the group consisting of 1-ethyl-3-methylimidazolium dicyanamide (EMI-DCA), N-butyl-N-methylpyrrolidinium dicyanamide (BMP-DCA), tributylmethyl ammonium dicyanamide ($Bu_3MeN$-DCA), N-ethylpyridinium dicyanamide, and mixtures thereof.

Furthermore, in the present invention, the ionic liquid serving as the electrolyte may provide a wide potential window to facilitate the replacement reaction. For example, the ionic liquid used in the present invention may have a potential window of 2.0 V or more, and preferably 3.0-4.5 V.

According to the surface treatment method of the present invention, in the step (B), the metal ion is present at a concentration of 0.05-0.5M in the ionic liquid solution, preferably 0.1-0.5 M, and more preferably 0.1-0.3 M. In addition, in the step (B), the metal substrate may be immersed in the ionic liquid solution for a time period of 1 second to 24 hour, and preferably 1 to 300 minutes.

In the surface treatment method provided by the present invention, a metal coating layer may be formed by reducing the metal ions in the ionic liquid solution on the surface of a metal substrate without energy supply. The ionic liquid not only has an extremely low volatility and is non-flammable, complying with operation safety, but also has minimal environmental impact compared to the current process liquids for anodic or chemical conversion treatments.

DETAILED DESCRIPTION OF THE PREFERRED EMBODIMENT

Example 1

An adequate amount of CuCl was dissolved in an N-butyl-N-methylpyrrolidinium dicyanamide (BMP-DCA) ionic liquid, to form an ionic liquid solution containing 0.1M of Cu+ ion, wherein, the N-butyl-N-methylpyrrolidinium dicyanamide (BMP-DCA) ionic liquid is represented by Formula (IX):

(IX)

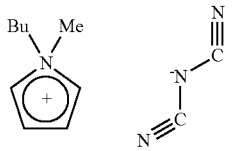

Figure 1:
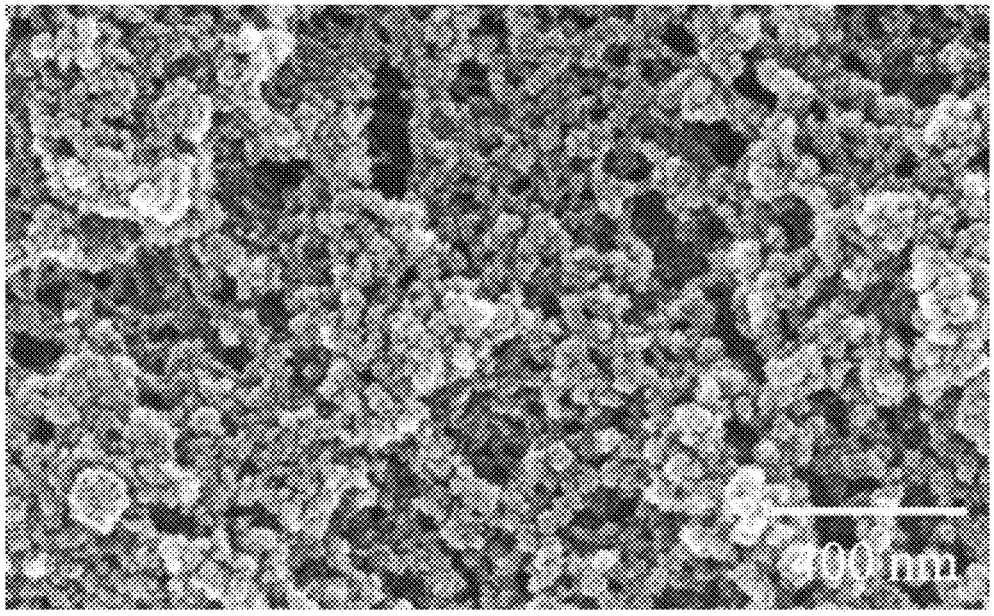
FIG. 1 shows a SEM image of the surface of the magnesium metal specimen according to Example 1 of the present invention.

Then, the magnesium metal specimen was immersed in a metal ionic liquid solution containing Cu+ ions to proceed with a replacement reaction. After 24 hours of reaction, the surface of the magnesium metal specimen was washed with the anhydrous ethanol, and the change of the surface morphology was observed by a scanning electron microscope (SEM). As can be clearly observed from the surface morphology illustrated in FIG. 1, a copper layer was coated on the surface of the magnesium metal specimen.

Example 2

Figure 2:
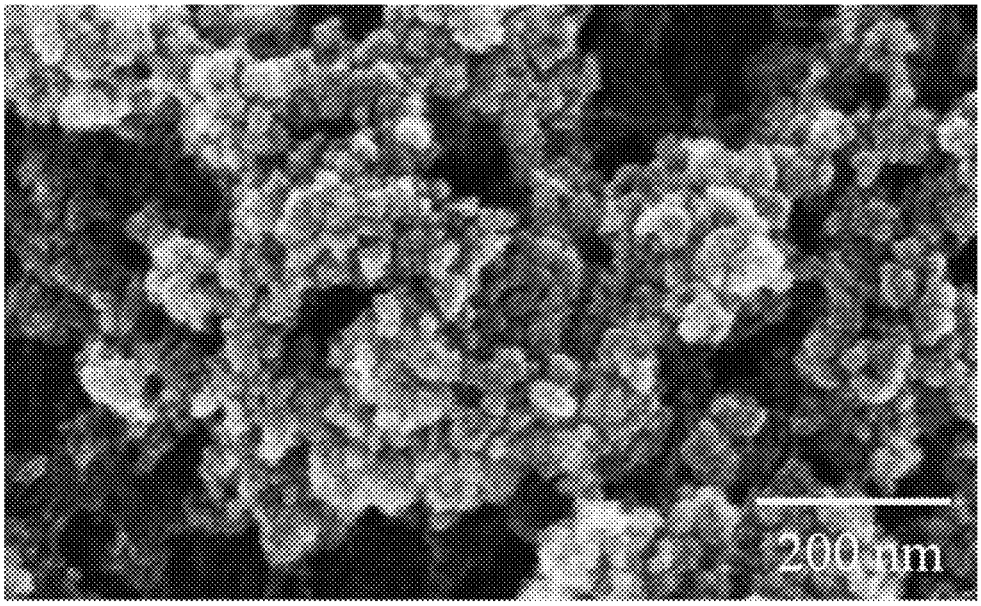
FIG. 2 shows a SEM image of the surface of the magnesium metal specimen according to Example 2 of the present invention.

An adequate amount of $NiCl_2$ was dissolved in an N-butyl-N-methylpyrrolidinium dicyanamide (BMP-DCA) ionic liquid, to form a $NiCl_2$ ionic liquid solution containing 0.1M of $Ni^{2+}$ ion. Then, the magnesium metal specimen was immersed in a metal ionic liquid solution containing $Ni^{2+}$ ions to proceed with a replacement reaction. After 24 hours of reaction, the surface of the magnesium metal specimen was washed with the anhydrous ethanol, and the change of the surface morphology was observed by using a scanning electron microscope (SEM). As can be clearly observed from the surface morphology illustrated in FIG. 2, a nickel layer was coated on the surface of the magnesium metal specimen.

Example 3

Figure 3:
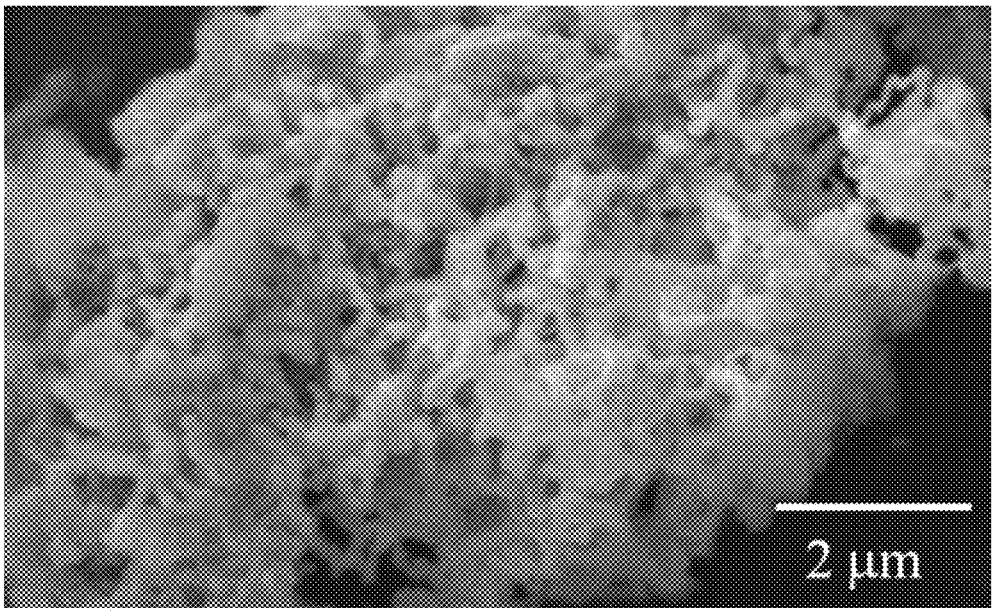
FIG. 3 shows a SEM image of the surface of the magnesium metal specimen according to Example 3 of the present invention.

An adequate amount of $ZnCl_2$ was dissolved in an N-butyl-N-methylpyrrolidinium dicyanamide (BMP-DCA) ionic liquid, to form an $NiCl_2$ ionic liquid solution containing 0.1M of $Zn^{2+}$ ion. Then, the magnesium metal specimen was immersed in a metal ionic liquid solution containing $Zn^{2+}$ ions to proceed with a replacement reaction. After 24 hours of reaction, the surface of the magnesium metal specimen was washed with the anhydrous ethanol, and the change of the surface morphology was observed by using a scanning electron microscope (SEM). As can be clearly observed from the surface morphology illustrated in FIG. 3, a zinc layer was coated on the surface of the magnesium metal specimen.

Example 4

Figure 4:
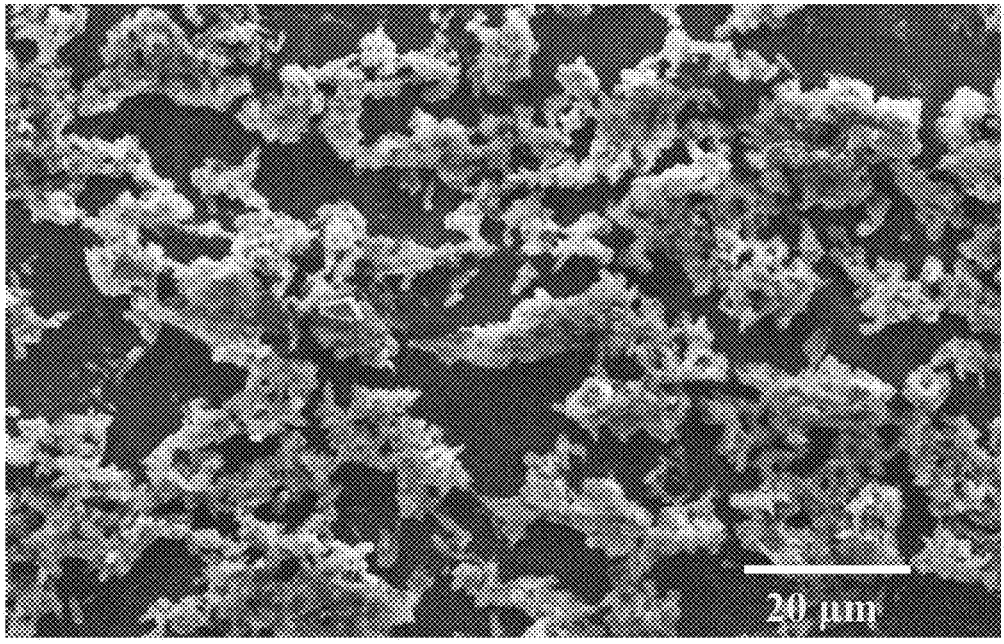
FIG. 4 shows a SEM image of the surface of the magnesium metal specimen according to Example 4 of the present invention.

An adequate amount of $TiF_4$ was dissolved in an N-butyl-N-methylpyrrolidinium dicyanamide (BMP-DCA) ionic liquid, to form an $NiCl_2$ ionic liquid solution containing 0.1M of $Ti^{4+}$ ion. Then, the magnesium metal specimen was immersed in a metal ionic liquid solution containing $Ti^{4+}$ ions to proceed with a replacement reaction. After 24 hours of reaction, the surface of the magnesium metal specimen was washed with the anhydrous ethanol, and the change of the surface morphology was observed by using a scanning electron microscope (SEM). As can be clearly observed from the surface morphology illustrated in FIG. 4, a titanium layer was coated on the surface of the magnesium metal specimen.

Example 5

An adequate amount of CuCl was dissolved in a 1-ethyl-3-methylimidazolium dicyanamide (EMI-DCA) ionic liquid, to form an ionic liquid solution containing 0.1M of $Cu^{+}$ ion, wherein, the 1-ethyl-3-methylimidazolium dicyanamide (EMI-DCA) ionic liquid is represented by Formula (X):

(X)

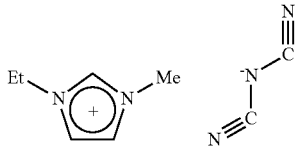

Figure 5:
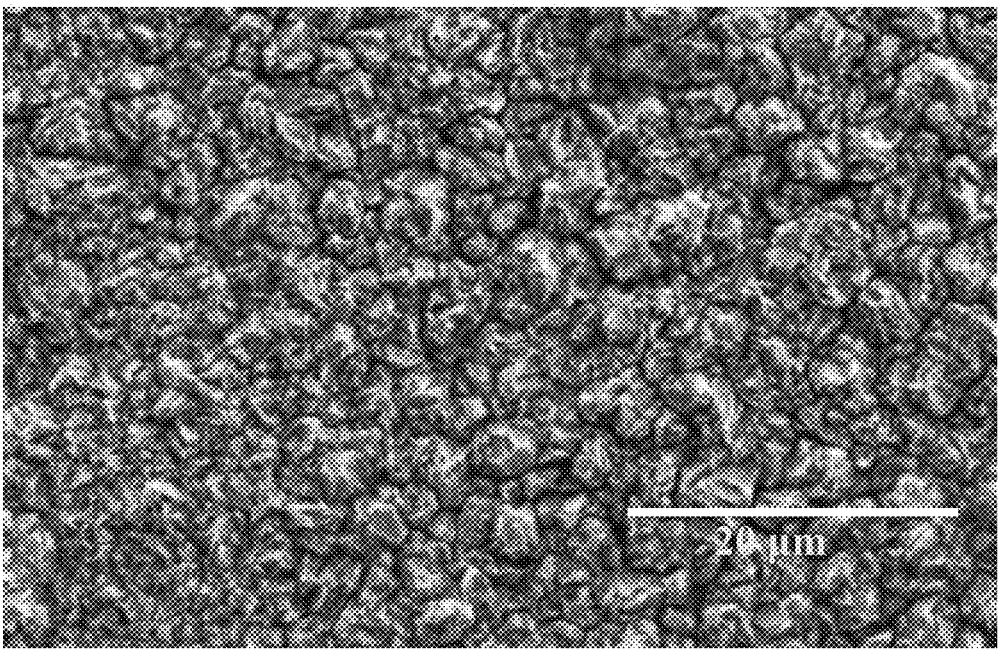
FIG. 5 shows a SEM image of the surface of the zinc metal specimen according to Example 5 of the present invention.
Figure 6:
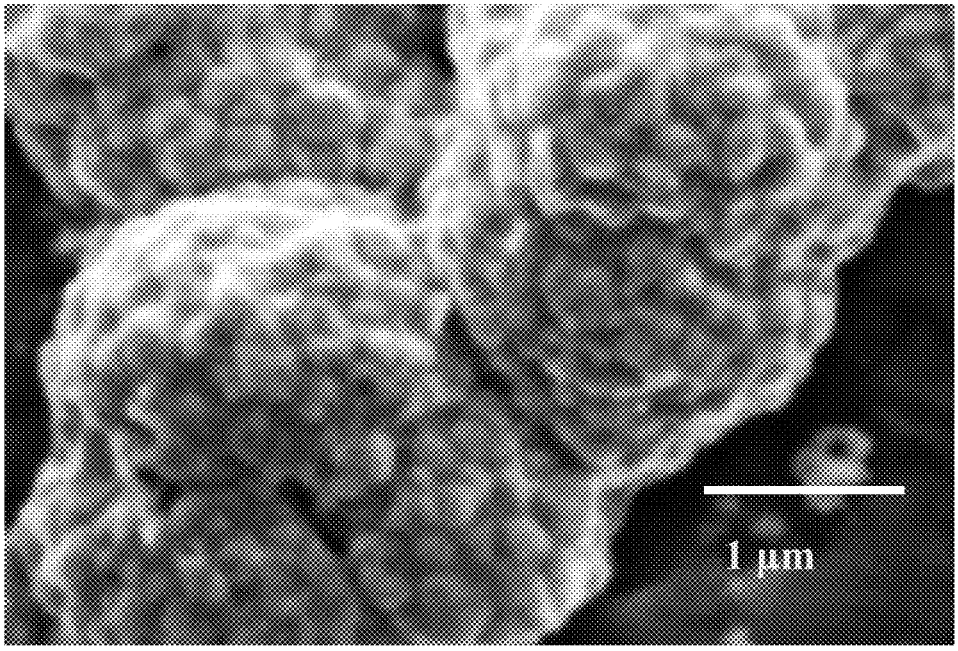
FIG. 6 shows a SEM image of the surface of the aluminum metal specimen according to Example 6 of the present invention.

Then, the zinc metal specimen was immersed in a metal ionic liquid solution containing $Cu^{+}$ ions to proceed with a replacement reaction. After 24 hours of reaction, the surface of the zinc metal specimen was washed with the anhydrous ethanol, and the change of the surface morphology was observed by using a scanning electron microscope (SEM). As can be clearly observed from the surface morphology illustrated in FIG. 5, a copper layer was coated on the surface of the zinc metal specimen.

Example 6

An adequate amount of CuCl was dissolved in a tributylmethyl ammonium dicyanamide ($Bu_3MeN$-DCA) ionic liquid, to form an ionic liquid solution containing 0.1M of $Cu^{1}$ ion, wherein, the $Bu_3MeN$-DCA ionic liquid is represented by Formula (XI):

(XI)

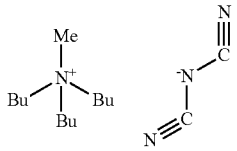

Then, the aluminum metal specimen was immersed in a metal ionic liquid solution containing Cu+ ions to proceed with a replacement reaction. After 24 hours of reaction, the surface of the aluminum metal specimen was washed with the anhydrous ethanol, and the change of the surface morphology was observed by using a scanning electron microscope (SEM). As can be clearly observed from the surface morphology illustrated in FIG. 5, a copper layer was coated on the surface of the aluminum metal specimen.

Comparative Example 1

The magnesium metal specimen was immersed in a pure BMP-DCA ionic liquid solution. After 24 hours of reaction, the surface of the magnesium metal specimen was washed with the anhydrous ethanol, to serve as a comparative magnesium metal specimen of the present invention.

Test Example 1

Figure 7:
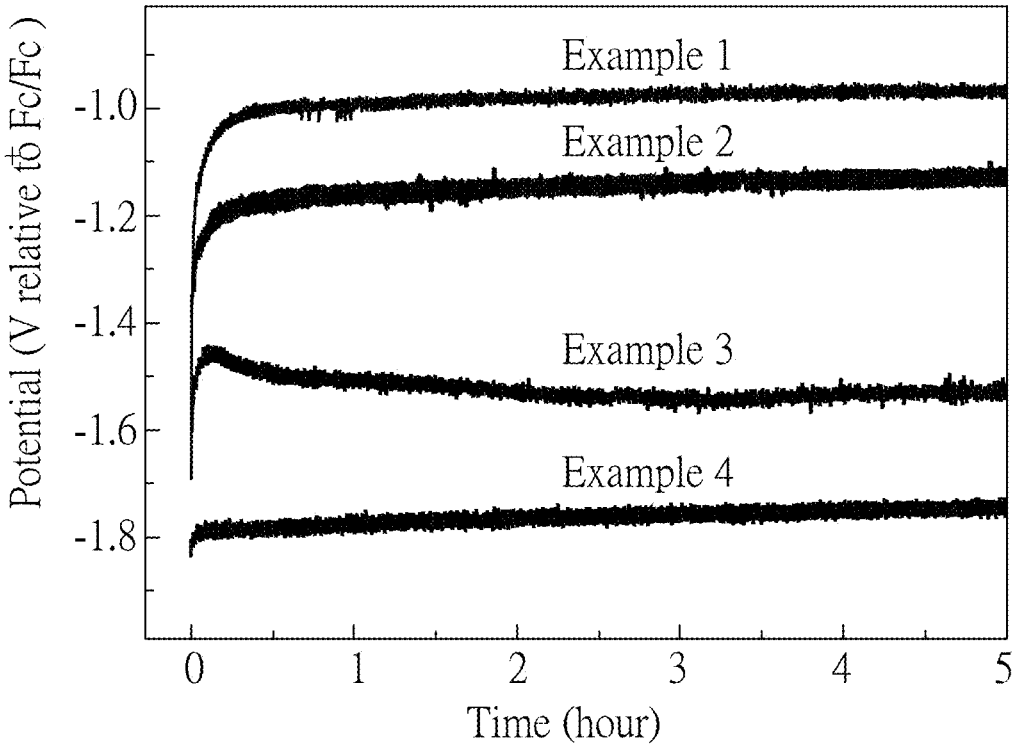
FIG. 7 is a schematic diagram showing the measurement results of the open circuit potential of the magnesium metal specimen during the metal replacement reaction according to Examples 1-4 of the present invention.

In the replacement reactions of Example 1 to Example 4, the magnesium metal specimen was used as a working electrode, platinum was used as an auxiliary electrode, and a platinum wire placed in Ferrocene/Ferrocenium(Fc/Fc$^{+}$=50/50 mol %) as the reference electrode. The three electrodes were then connected to Biologic SP-150, to measure the change of the open circuit potential of the magnesium metal specimen during the replacement reactions of Examples 1-4. The measurement results of the open circuit potential was shown in FIG. 7, wherein the magnesium ions contacted with the ionic liquid containing metal to initiate the replacement reaction to reduce the metal ions in solution on the surface of the magnesium metal. Because the reduced metal ions had a higher open circuit potential in the liquid, the open circuit potential was increased soon after the reaction started, and it can be observed for the result of the figure that the open circuit potential was increased rapidly in half an hour, indicating that the replacement reaction was quite fast.

Test Example 2

Real-time analysis of X-ray absorption spectroscopy was conducted on the surface of the magnesium metal specimens of Examples 1-2 when the replacement reaction was taking place.

Test Example 2-1

Figure 8:
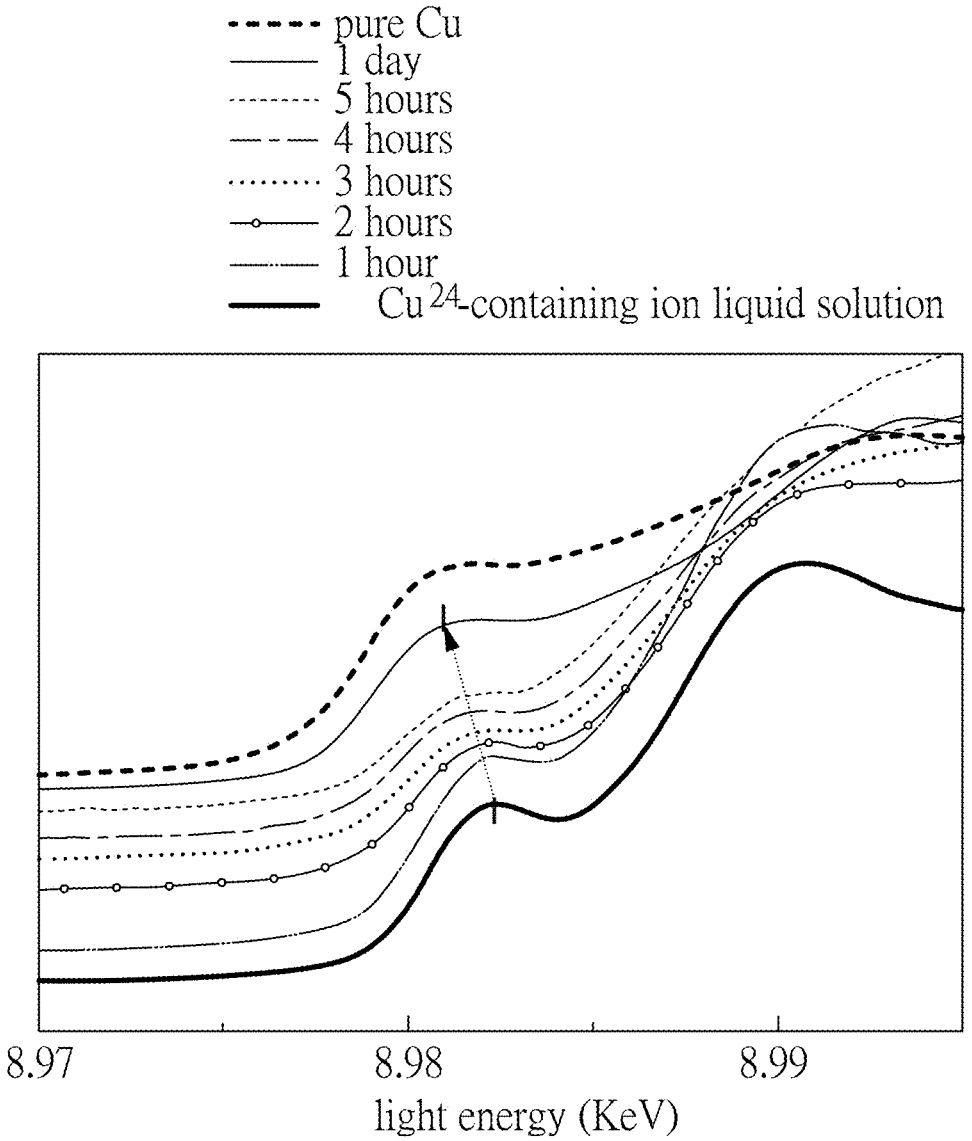
FIG. 8 is a schematic diagram showing the analysis results of the real-time X-ray absorption spectroscopy of the magnesium metal specimen during the metal replacement reaction according to Example 1 of the present invention.

In Example 1, the magnesium metal specimen was immersed in an ionic liquid solution containing $Cu^{+}$ ions, to carry out the replacement reaction. The real-time analysis of X-ray absorption spectroscopy of the magnesium metal surface was conducted after 1, 2, 3, 4, and 5 hours and 1 day after the replacement reaction started, and the X-ray absorption spectroscopy was shown in FIG. 8. In the replacement reaction of Example 1, as the $Cu^{+}$ ions in the ionic liquid into were converted into a metallic state (Cu) and adhered onto the surface of the magnesium metal specimen to form a metal coating layer, the absorption peak of X-rays gradually shifted to the lower energy of pure metallic state with the progress of the replacement reaction, and the inflection point was close to the position of pure copper. Therefore, it can be deduced that the metal coating layer formed on the surface of the magnesium metal specimen during the replacement reaction in the ionic liquid was copper metal.

Test Example 2-2

Figure 9:
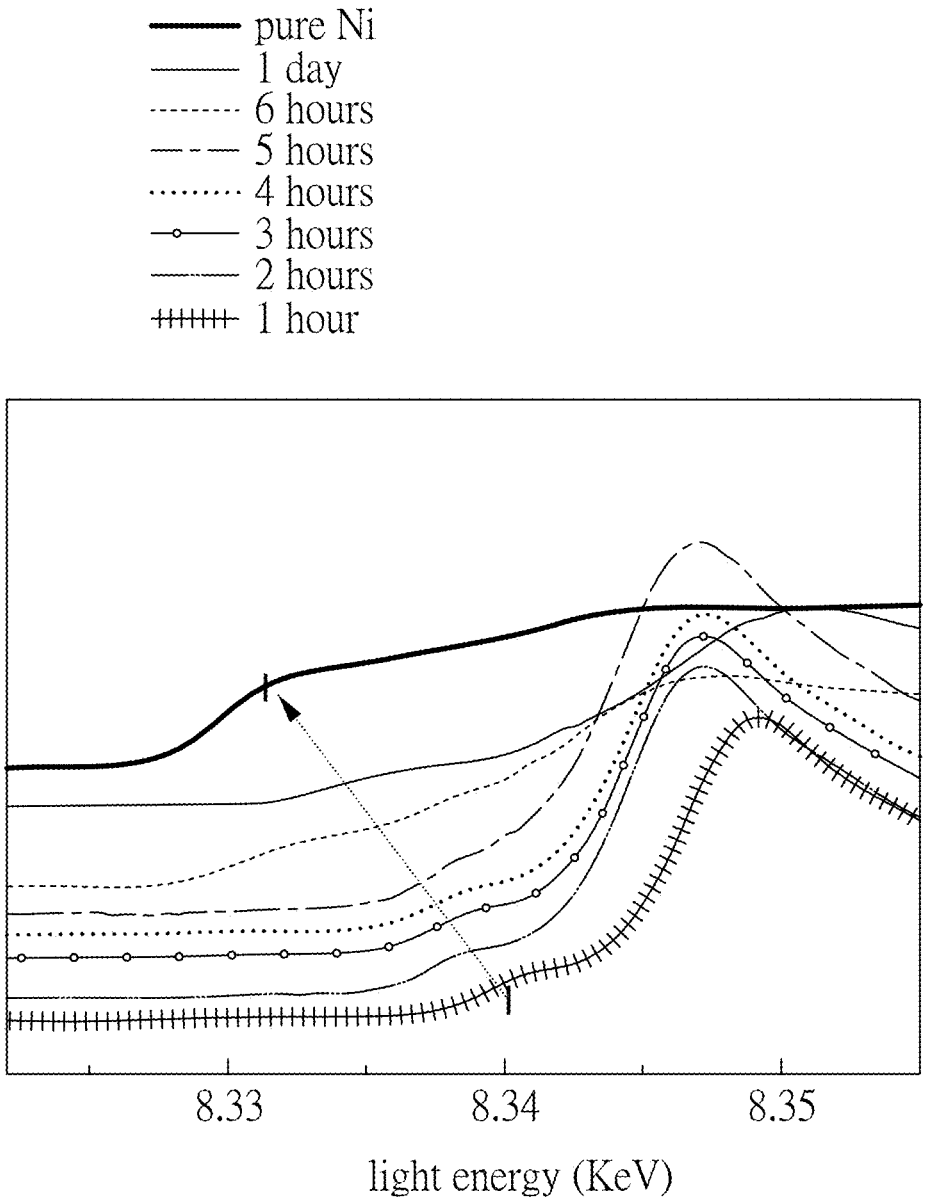
FIG. 9 is a schematic diagram showing the analysis results of the real-time X-ray absorption spectroscopy of the magnesium metal specimen during the metal replacement reaction according to Example 2 of the present invention.

In Example 2, the magnesium metal specimen was immersed in an ionic liquid solution containing $Ni^{2+}$ ions, to carry out the replacement reaction. The real-time analysis of X-ray absorption spectroscopy of the magnesium metal surface was conducted after 1, 2, 3, 4, and 5 hours and 1 day after the replacement reaction started, and the X-ray absorption spectroscopy was shown in FIG. 9. In the replacement reaction of Example 2, as the $Ni^{2+}$ ions in the ionic liquid were converted into a metallic state (Ni) and adhered onto the surface of the magnesium metal specimen to form a metal coating layer, the absorption peak of X-rays gradually shifted to the lower energy of pure metallic state with the progress of the replacement reaction. Therefore, it can be deduced that the metal coating layer formed on the surface of the magnesium metal specimen during the replacement reaction in the ionic liquid was nickel metal.

Test Example 3

Figure 10:
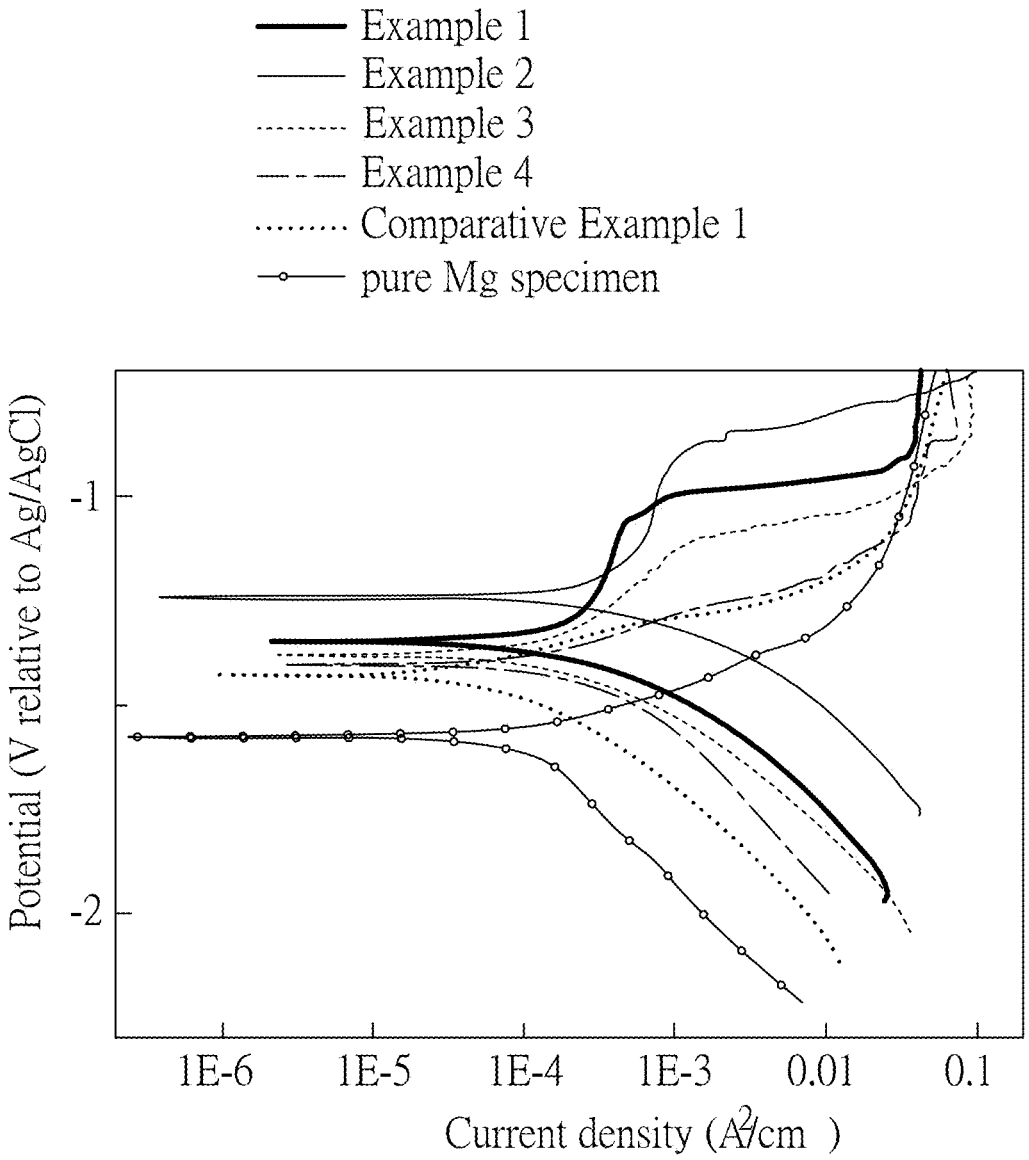
FIG. 10 is a schematic diagram of the polarization curve according to Examples 1-4 of the present invention and Comparative Example 1.

The coated magnesium metal specimens prepared in Example 1 to Example 4 and Comparative Example 1 and a pure magnesium metal specimen as the working electrode, a platinum wire as the auxiliary electrode, and Ag/AgCl as the reference electrode, were placed in an etching solution (0.1 M of $Na_2SO_4$) in an anaerobic environment. The polarization curve was measured at a scanning speed of 5 mV/sec, and the measurement result was shown in FIG. 10. The corrosion potential ($E_{corr}$) of the coated magnesium metal specimens prepared in Example 1 to Example 4 and Comparative Example 1 and a pure magnesium metal specimen, and the anodic current density ($i_a$) under a potential of −1.2 V, shown in FIG. 10 are summarized in Table 1:

TABLE 1

| | $E_{corr}$ (V vs. Ag/AgCl) | $i_a$ (at −1.2 V) (A/cm$^2$) |
|---|---|---|
| Example 1 | −1.34 | $3.3 \times 10^{-4}$ |
| Example 2 | −1.24 | $2.7 \times 10^{-4}$ |
| Example 3 | −1.38 | $5.9 \times 10^{-4}$ |
| Example 4 | −1.40 | $7.9 \times 10^{-4}$ |
| Comparative Example 1 | −1.42 | $10.1 \times 10^{-4}$ |
| pure magnesium metal specimen | −1.57 | $19.0 \times 10^{-4}$ |

It can be can be clearly observed form the test result of this Example, that the corrosion potentials of the magnesium metal specimens provided by Example 1 to Example 4 after the replacement reaction were all higher than the magnesium metal specimen and the pure magnesium metal specimen of Comparative Example 1. Especially, for the pure magnesium metal specimen as the control group, when the potential is higher than its corrosion potential (−1.57 V), the current rises rapidly, showing poor corrosion resistance.

In Example 1, the magnesium metal specimen with surface replacement of copper had a corrosion potential increasing from −1.57 V to −1.34 V (relative to Ag/AgCl). In Example 2, the magnesium metal specimen with surface replacement of nickel had a corrosion potential increasing from −1.57 V to −1.24 V (relative to Ag/AgCl). In Example 3, the magnesium metal specimen with surface replacement of zinc had a corrosion potential increasing from −1.57 V to −1.38 V (relative to Ag/AgCl). In addition, it can be observed from the polarization curves shown in FIG. 10 that in Example 1 and Example 2, when the potential was larger than the corrosion potential, the specimens exhibited a passivation effect, and until the scanning potential was greater than about −1 V, the current density was increased to the limiting current. Accordingly, it can be proved that the magnesium metal specimens having the metal coating (copper and nickel) provided by Examples 1-2 had a significantly improved and quite excellent corrosion resistance.

The magnesium metal specimen having a titanium metal coating provided by Example 4 also had an improved corrosion resistance increasing from −1.57 V to −1.40 V. Although with the rise of the potential, no passivation effect was generated, the increase of the corrosion potential indeed, improved the corrosion resistance of the magnesium metal specimen.

The results of the Test Example indicate that the formation of the copper coating layer on the magnesium metal specimens by the replacement reaction of the present invention may significantly improve the corrosion resistance of the magnesium metal specimens.

Although the present invention has been explained in relation to its preferred embodiment, it is to be understood that many other possible modifications and variations can be made without departing from the spirit and scope of the invention as hereinafter claimed.

What is claimed is:

1. A method for treating a metal surface, comprising:

(A) providing an ionic liquid solution and a substrate of a first metal, wherein the ionic liquid solution comprises an ionic liquid and an ion of a second metal; and (B) immersing the substrate of the first metal in the ionic liquid solution to form a coating layer of the second metal on a surface of the substrate of the first metal by reducing the ion of the second metal, and the second metal has a reduction potential higher than the first metal, wherein the coating layer of the second metal is formed on the surface of the substrate of the first metal without energy supply.

2. The method of claim 1, wherein the substrate of the first metal is selected from the group consisting of magnesium, aluminum, zinc, titanium, iron, cobalt, nickel, silver, vanadium, chromium and alloys thereof.

3. The method of claim 1, wherein the ion of the second metal is selected from the group consisting of a copper ion, a nickel ion, a zinc ion, a titanium ion, an aluminum ion, a cobalt ion, a silver ion, a gold ion, a vanadium ion, a chromium ion, a manganese ion, a platinum ion, a palladium ion, and mixtures thereof.

4. The method of claim 1, wherein the ionic liquid comprises at least one cation selected from the group consisting of the cations represented by Formulas (I) to (VIII);

(I)

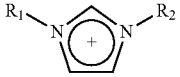

(II)

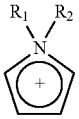

(III)

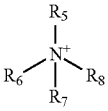

(IV)

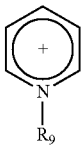

(V)

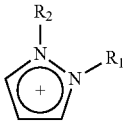

(VI)

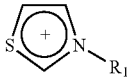

(VII)

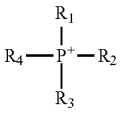

-continued (VIII)

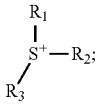

wherein each of $R_1$, $R_2$, $R_3$ and $R_4$, independently, is a hydrogen or a $C_{1-10}$ alkyl group.

5. The method of claim 1, wherein the ionic liquid comprises at least one cation selected from the group consisting of the cations represented by Formulas (I) to (VIII);

(I)

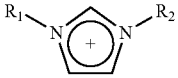

(II)

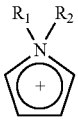

(III)

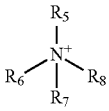

(IV)

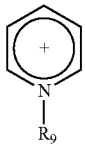

(V)

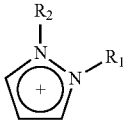

(VI)

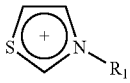

(VII)

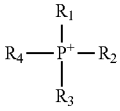

(VIII)

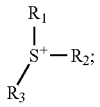

wherein, each of $R_1$, $R_2$, $R_3$ and $R_4$, independently, is a $C_{1-5}$ alkyl group.

6. The method of claim 1, wherein the ionic liquid comprises at least one anion selected from the group consisting of the anions represented by Formulas (1) to (5);

(1)

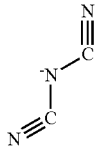

(2)

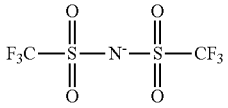

(3)

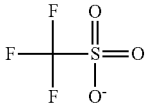

(4)

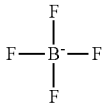

-continued (5)

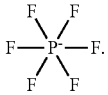

7. The method of claim 1, wherein the ionic liquid is selected from the group consisting of 1-ethyl-3-methylimidazolium dicyanamide, N-butyl-N-methylpyrrolidinium dicyanamide, tributylmethyl ammonium dicyanamide, N-ethylpyridinium dicyanamide, and mixtures thereof.

8. The method of claim 1, wherein the metal ion is present at a concentration of 0.05-0.5M in the ionic liquid solution.

9. The method of claim 1, wherein the ionic liquid has a potential window of above 2.0 V.

* * * * *